US006105547A

United States Patent [19]

Sakamoto et al.

[11] Patent Number: 6,105,547

[45] Date of Patent: Aug. 22, 2000

[54] AIR INTAKE DEVICE FOR AN INTERNAL COMBUSTION ENGINE

[75] Inventors: Kazuya Sakamoto; Taketoshi Matsumoto; Takamasa Murata, all of Hamakita, Japan

[73] Assignee: Toyo Roki Seizo Kabushiki Kaisha, Shizuoka-ken, Japan

[21] Appl. No.: 09/315,339

[22] Filed: May 20, 1999

[30] Foreign Application Priority Data

May 22, 1998 [JP] Japan ..... 10-141646

[51] Int. Cl.[7] ..... F02M 35/12

[52] U.S. Cl. ..... 123/184.57

[58] Field of Search ..... 123/184.57; 181/204, 181/205

[56] References Cited

U.S. PATENT DOCUMENTS

| | | | |
|---|---|---|---|
| 4,538,556 | 9/1985 | Takeda | 123/184.57 |
| 5,002,021 | 3/1991 | Nakata et al. | 123/184.57 |
| 5,107,800 | 4/1992 | Araki et al. | 123/184.57 |
| 5,255,638 | 10/1993 | Sasaki et al. | 123/184.57 |
| 5,839,405 | 11/1998 | Falkowski et al. | 123/184.57 |
| 5,957,102 | 9/1999 | Schorn | 123/184.57 |

*Primary Examiner*—Marguerite McMahon
*Attorney, Agent, or Firm*—Young & Thompson

[57] ABSTRACT

The air intake device for an internal combustion engine comprises a cleaner case in which a filter element is accommodated, a first duct for introducing air into a dusty side of the cleaner case, a second duct for introducing the air from a clean side of the cleaner case toward the internal combustion engine, and at least one resonator formed as a closed container and connected to one of the first or the second duct. Said at least one resonator and the cleaner case are arranged side by side, and the first and the second ducts are extended along the resonator.

8 Claims, 8 Drawing Sheets

AIR INTAKE DEVICE FOR AN INTERNAL COMBUSTION ENGINE

BACKGROUND OF THE INVENTION

1. Field of the Invention

The present invention relates to an air intake device to be connected to an internal combustion engine of a vehicle.

2. Description of the Related Art

As an air intake device to be connected to an internal combustion engine of an automobile, there is an approach in which a resonator formed as a closed box is connected to an intake duct to thereby reduce intake noises. The resonator is housed in a space inside a fender panel of a vehicle and is away from an air cleaner provided in an engine compartment with an engine compartment partition panel being located therebetween (for example, refer to Japanese Patent Laid Open Publication HEI8-193548).

The noise reduction effect of the above mentioned resonator depends on its resonance frequency, and the resonance frequency is changed in accordance with the volume of the resonator, the length of a communication pipe connecting the resonator and the intake duct to each other, the cross-sectional area of the communication pipe or the like. On the other hand, the intake noise of the internal combustion engine may be changed in accordance with the type of engine. Accordingly, if the internal combustion engine is varied, it would be necessary to change the volume of the resonator and/or the dimensions of the communication pipe, while the common resonator can be used for the same type of engine.

However, the space inside the fender panel of the vehicle, in which the resonator is provided, may variously be changed in accordance with the configuration of the fender panel, the structure of a suspension system and the like. Accordingly, it is necessary to change the design of the resonator in accordance with the type or the specification of the car, even if the same internal combustion engine is used therein.

SUMMARY OF THE INVENTION

One object of the present invention is to provide an air intake device in which an air cleaner and a resonator are gathered to allow the intake device to be located near an engine, thereby reducing possibility that design changes are required in accordance with the difference in the type or the specification of the car.

The present invention will now be described. Incidentally, in order to well understand the present invention, in the following description, the reference numerals are to be added to the components or members in parenthesis, but it is apparent that the present invention is not limited to the embodiments shown in the drawings.

In order to attain above-described and other objects of the present invention, according to one aspect of the present invention, there is provided an air intake device (10) for an internal combustion engine (1) comprising a cleaner case (12) in which a filter element (11) is housed, a first duct (13) for introducing air into a dusty side (Sd) of the cleaner case, a second duct (14) for introducing the air from a clean side (Sc) of the cleaner case toward the internal combustion engine, and at least one resonator (15, 16) formed as a closed box and connected to one of the first or the second duct, wherein said at least one resonator and the cleaner case are arranged side by side, and the first and the second ducts are extended along the resonator.

According to this invention, since the cleaner case and the resonator are arranged side by side, and the ducts are extended around them, it is possible to efficiently gather at least part of components provided in an extent from an inlet of an intake system via the cleaner case to the internal combustion engine to thereby provide the intake device with a compact design. As a result, it is possible to dispose the resonator near the engine together with the cleaner case. Thus, it is possible to use the common intake device as long as the common internal combustion engine is used with keeping a space for locating the intake device in a periphery thereof, even if the type of vehicle is changed. In comparison with a case of keeping a common space, in all types of vehicle, inside a fender panel which is apt to be affected by a vehicle external appearance or the like, it is far easy to evenly keep a common space for locating the intake device of the present invention in a periphery of the engine, in other words in an engine compartment in all types of vehicle. Thus, it is possible to reduce the frequency of opportunity in which design change is required, and it is possible to provide the intake device with high flexibility.

In the above intake device, the cleaner case may have a case main body (12A) and a case cap (12B) detachably mounted on the case main body, and at least one part of the resonator may integrally be formed with at least one part of the case main body.

According to this embodiment, at least one part of the resonator and at least one part of the cleaner case can simultaneously be formed by injection molding or the like, and thus it is possible to reduce the number of parts of the intake device and to make the intake device to be compact.

A side blanch (17) having a tubular shape with a closed end may be connected to a section of at least one of the first and the second ducts, the section may be located between connecting points at which the resonator and the cleaner case are connected to said at least one of the first and the second ducts, and the side branch may be fitted into a recess portion provided on the cleaner case or the resonator.

In this embodiment, the side branch does not jut out from faces of the intake device, so that the side branch may not be obstructive to the decision of the arrangement of the air intake device.

The first or the second duct may have a bending portion (14B) extending around the cleaner case while keeping space therefrom, and at least one part of the resonator may be fitted in the space between the bending portion and the cleaner case.

In this embodiment, it is possible to increase the entire length of the duct by being the duct away from the cleaner case, and at the same time, it is possible to practically use a space formed between the cleaner case and the duct by putting at least part of the resonator therein.

A plurality of resonators (15, 16) may be provided as said at least one resonator, the cleaner case may be located at one side of the intake device, the first and the second ducts may be provided at another side of the intake device, and the resonators may be gathered at said another side of the intake device. In this case, the resonators may be provided in a space formed between the first and the second ducts. The first and the second ducts may have portions substantially parallel to each other. At least one of the resonators may have a partitioning wall (20) which is commonly used as a wall of another one of the resonators.

Said at least one resonator may be connected through a generally straight communication pipe portion (19) to said one of the first or the second duct.

According to another aspect of the present invention, there is provided an air intake device for an internal combustion engine comprising a cleaner case (12) provided at one side of the intake device and housing therein a filter element (11), a first duct (13) for introducing air into a dusty side (Sd) of the cleaner case, a second duct (14) for introducing the air from a clean side (Sc) of the cleaner case toward the internal combustion engine, and a plurality of resonators (15, 16), each of which is formed as a closed box and connected to one of the first or the second duct, wherein the resonators are provided at another side of the intake device so as to be adjacent to the cleaner case, and the first and the second ducts are provided at said another side and extended along the resonators.

DESCRIPTION OF THE PREFERRED EMBODIMENTS

Embodiments of the present invention will now be described with reference to the accompanying drawings.

Figure 1A:
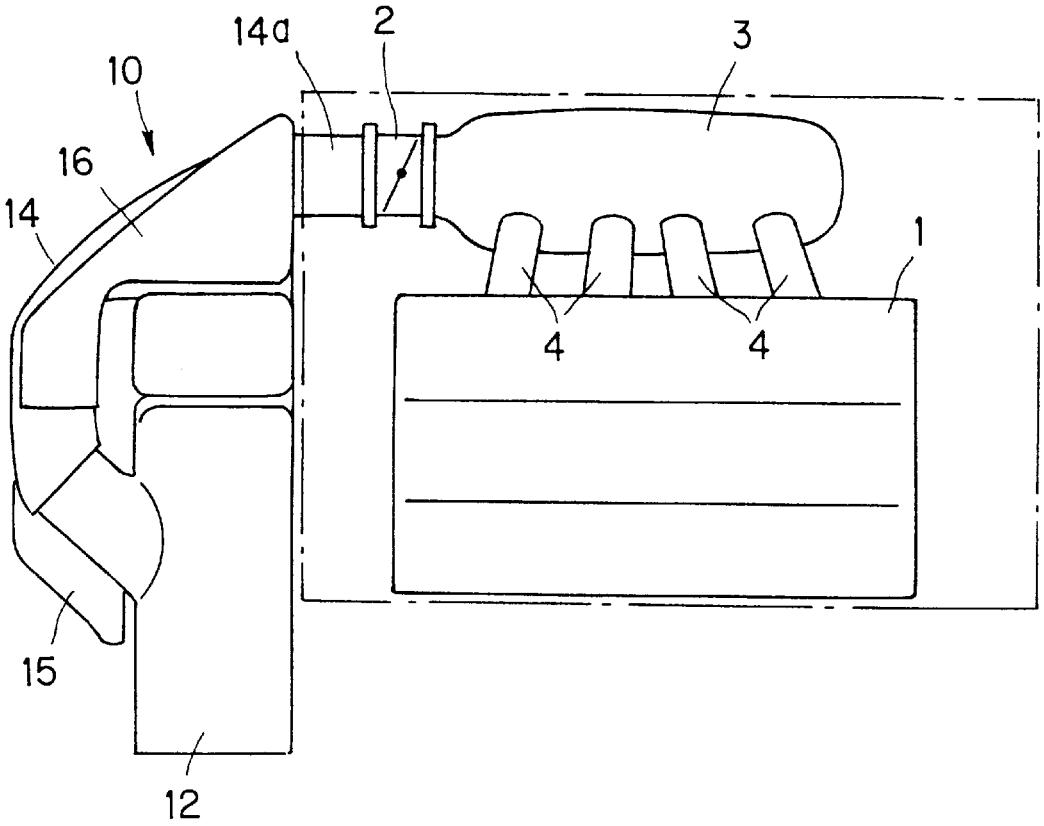
FIGS. 1A and 1B are plan and side views showing a relationship between an internal combustion engine and an air intake device according to an embodiment of the present invention.
Figure 1B:
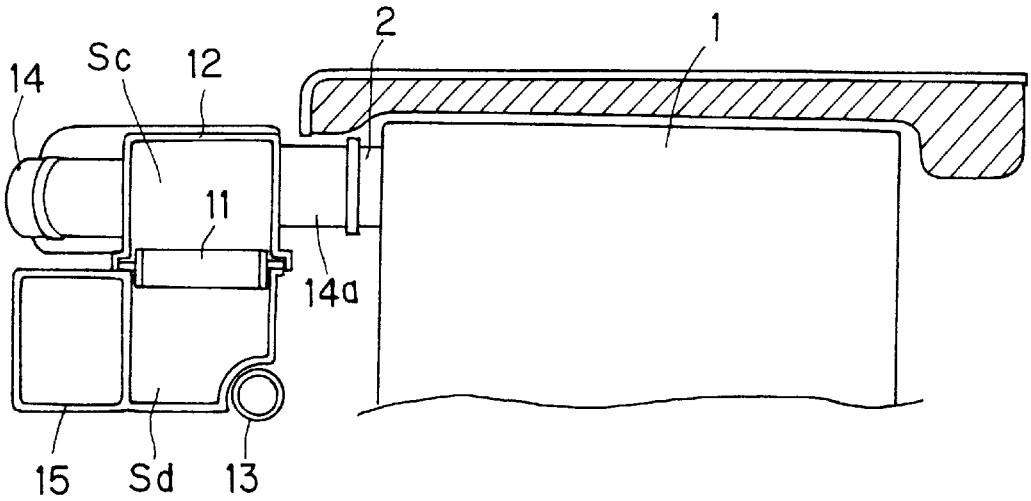

FIG. 1 shows an air intake device in accordance with an embodiment of the present invention. An air intake device 10 is arranged so as to be adjacent to an engine 1 in an engine compartment of a vehicle. The intake device 10 is prepared as a module comprising a cleaner case 12 housing therein a filter element 11, a first duct 13 for introducing air to a dusty side Sd of the cleaner case 12, a second duct 14 for introducing the air from a clean side Sc of the cleaner case 12 toward the engine 1, and first and second resonators 15 and 16 formed into a closed box shape and connected to the ducts 13, 14, respectively. The cleaner case 12, the ducts 13 and 14, and the resonators 15 and 16 are made of synthetic resin. The resonators 15 and 16 are provided for reducing intake noises in frequency bands which are different from each other, and each volume thereof is adjusted in accordance with the frequency band as a target.

The first duct 13 has a front end portion (not shown in the figure) which serves as an air inlet, and a funnel portion is provided thereto in accordance with the necessity. The second duct 14 has a rear end portion 14*a* to be connected to a throttle valve 2. The air passing through the throttle valve 2 is introduced through a surge tank 3 and intake manifolds 4 . . . 4 to an intake port of the engine 1. In the following explanation, an up-and-down direction in FIG. 1B will be considered as a vertical direction of the air intake device 10, however, an attaching posture of the air intake device 10 is not limited thereto.

FIGS. 2 to 5 show details of the air intake device 10. The cleaner case 12 can be divided at a position, at which the filter element 11 is mounted, into a case main body 12A and a case cap 12B in the vertical direction. The case main body 12A and the case cap 12B are formed into predetermined shapes by means of injection molding, respectively. By mounting a flange 11*a* of the filter element 11 on a flange support portion 12*a* of the case main body 12A and putting the case cap 12B thereon, the inner space of the filter case 12 is divided into the dusty side Sd and the clean side Sc with the filter element 11 being located therebetween. The case main body 12A and the case cap 12B are joined together by joining means such as a clip or the like.

The first duct 13 extends generally straight along a bottom portion 12*b* of the case main body 12A. The bottom portion 12*b* is formed with a recess portion 12*e* (see FIG. 2) in which the first duct 13 is fitted, and thus the projecting amount of the duct 13 from the cleaner case 12 is restricted to a necessary minimum value. A rear end portion 13*a* of the first duct 13 is bent upward and is inset into the dusty side Sd through the bottom portion 12*b*. In a section before the bent portion of the first duct 13, there is connected a side branch 17. The side branch 17 is formed into a tubular shape extending in a direction substantially perpendicular to the axial direction of the first duct 13, and its terminal end (an end portion opposite to a side connected to the duct 13) is closed. That is, the inner portion of the side branch 17 forms a blind alley. The side branch 17 is provided to reduce an intake noise in a particular frequency within a frequency band higher than those which are the targets of the resonators 15 and 16. The side branch 17 is fitted in a recess portion 12*c* provided on the cleaner case 12A of the cleaner case 12. Accordingly, the side branch 17 does not jut out from a side surface of the cleaner case 12, and thus the side branch 17 is not obstructive to the decision of the arrangement of the air intake device 10 in the engine compartment. Note that, the recess 12*c* may be formed on the resonator 15 instead of the case main body 12A, and the side branch 17 may be fitted therein.

The second duct 14 includes a junction portion 14A integrally formed with the case cap 12B and a bending portion 14B detachably connected to the junction portion 14A. The junction portion 14A may be inset into the clean side Sc of the cleaner case 12 for a predetermined length. Further, the inset portion of the junction portion 14A may be provided with a funnel portion. The bending portion 14B extends from the junction portion 14A toward its rear end portion 14*a*, bending in a clock wise direction so as to surround the cleaner case 12.

Figure 2:
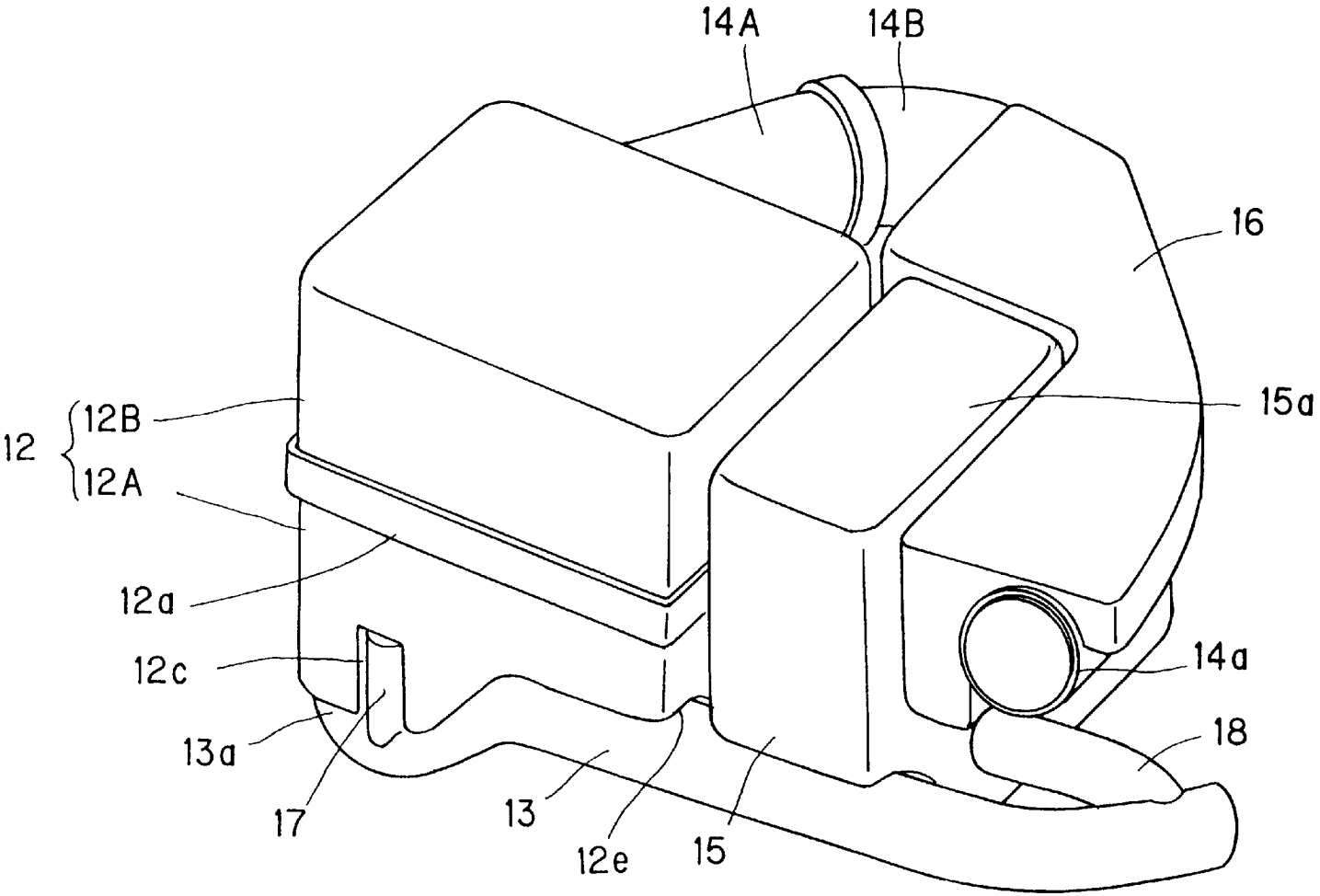
FIG. 2 is a perspective view of the air intake device shown in FIG. 1.

The first resonator 15 is formed into a general L shape when it is shown from the bottom side of the air intake device 10 (refer to FIG. 5) so as to partially surround the cleaner case 12, and one part 15*a* thereof is located in a spa ce between the second duct 14 and the cleaner case 12 with an upper surface thereof being substantially flush with an upper surface of the ca se cap 12B (refer to FIG. 2). A lower surface of the resonator 15 is substantially flush with a lower surface of the case main body 12A of the cleaner case 12. The resonator 15 is connected to the first duct 13 through a communication pipe 18, and a connecting position, at which the communication pipe 18 and the duct 13 are connected to each other, is located in a section before the side branch 17. Note that, the inner space of the resonator 15 does not communicate with anywhere in the air intake device 10 except for the communication pipe 18.

Figure 4:
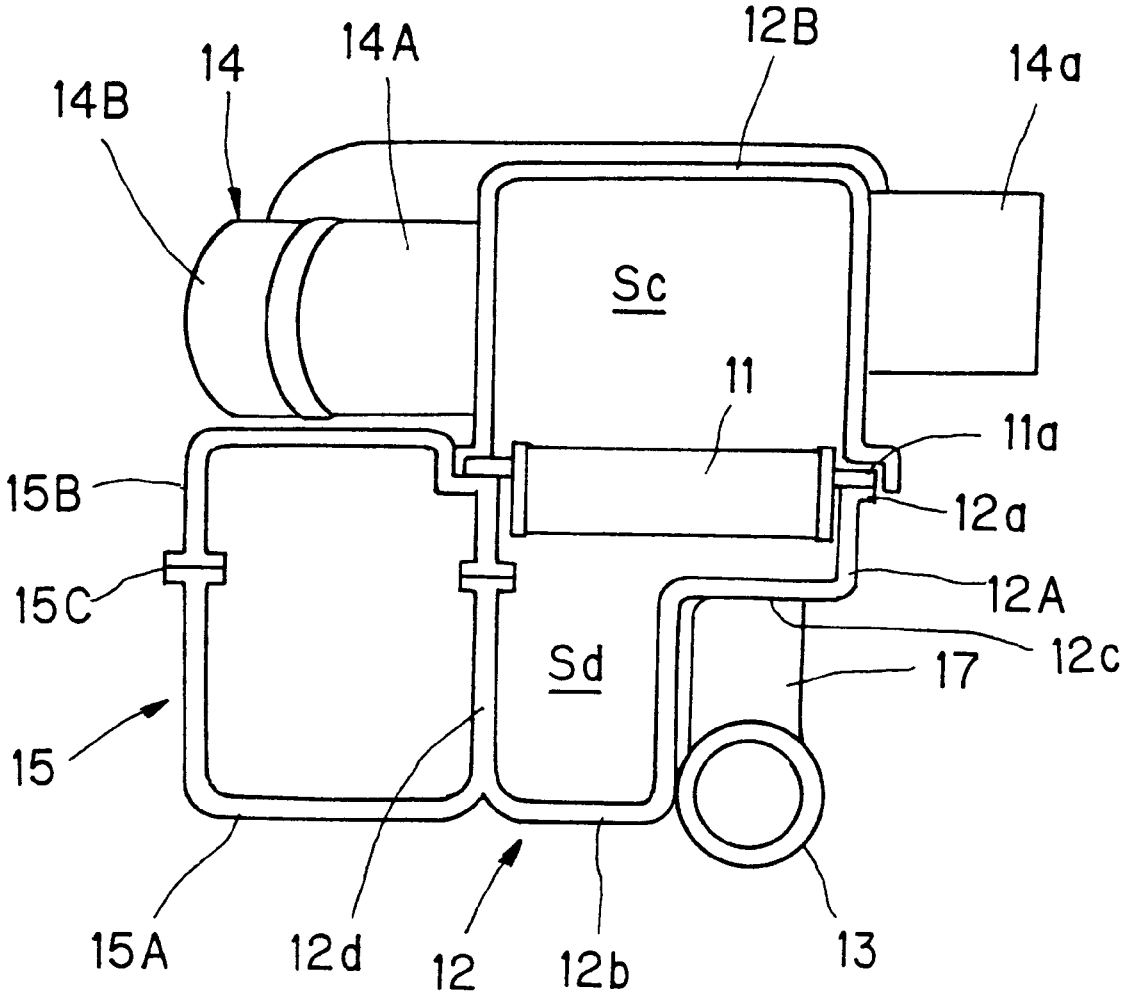
FIG. 4 is a vertical sectional view of the air intake device shown in FIG. 2.
Figure 5:
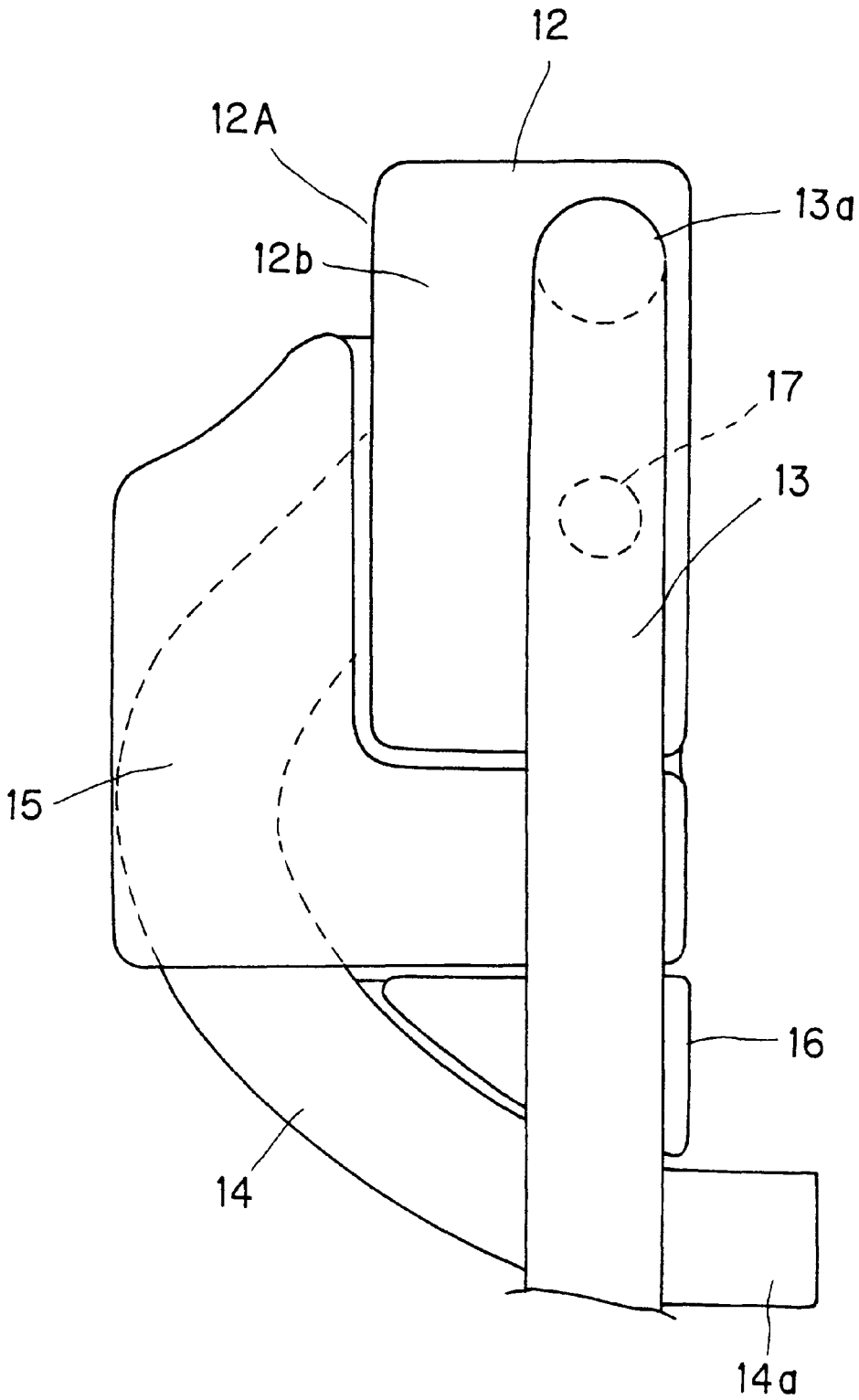
FIG. 5 is a bottom plan view of the air intake device shown in FIG. 2.

As is apparent from FIG. 4, the resonator 15 is integrally formed with the case main body 12A of the cleaner case 12, and one part of the wall of the resonator 15 also serves as a wall portion 12*d* of the cleaner case 12. Incidentally, the resonator 15 has to be a closed box as mentioned above, and it is difficult to form the entire body thereof all at once. Accordingly, one preferable process for preparing the resonator 15 is that a lower case 15A and an upper case 15B are separately formed, and then the cases 15A and 15B are joined together at a joint line 15C. The cases 15A and 15B can be joined, for example, by means of ultrasonic welding. At least one of the cases 15A and 15B can be formed by the injection molding together with the case main body 12A of the cleaner case 12. Incidentally, in the embodiment shown in FIG. 4, the upper case 15B is formed with a part of the flange support portion 12*a*, and the part of each of the cases 15A and 15B serves as a part of the case main body 12A. However, only the lower case 15A may integrally be formed with the case main body 12A, and the upper case 15B may entirely be separated from the cleaner case 12.

Figure 3:
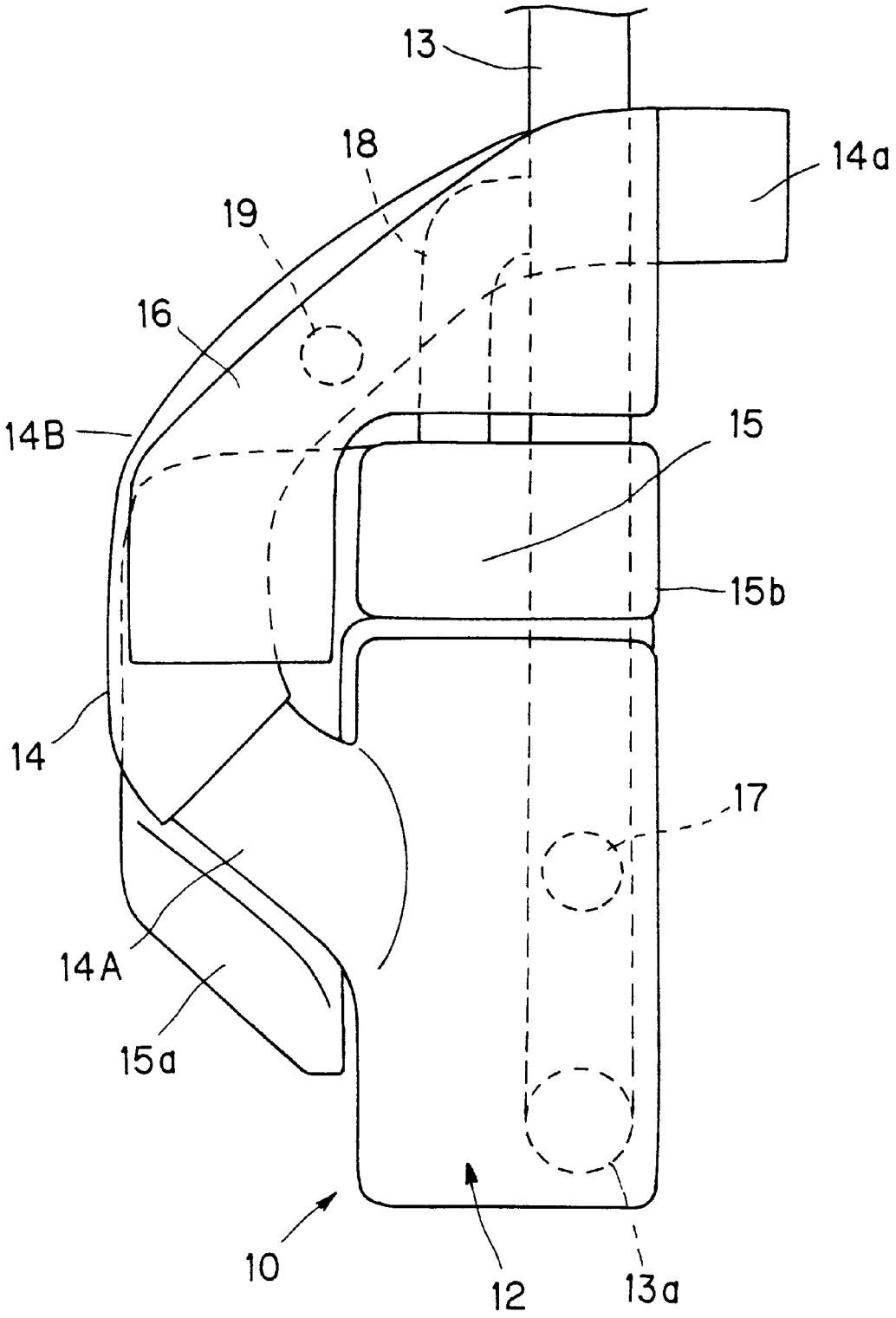
FIG. 3 is a plan view of the air intake device shown in FIG. 2.

As is apparent from FIGS. 2 and 3, the second resonator 16 is provided in a manner of covering the second duct 14 from the above, and is connected through a generally straight communication pipe 19 to a halfway position of the bending portion 14B of the second duct 14. An upper surface of the resonator 16 is located so as to be substantially flush with the upper surface of the case cap 12B of the cleaner case 12. Note that, the inner space of the resonator 16 does not communicate with anywhere in the air intake device 10 except for the communication pipe 19. The resonator 16 may separately be formed from the bending portion 14B or the resonator 15. At lease one part of the resonator 16 ma y integrally formed with at least one part of the bending portion 14B or the resonator 15.

According to the above mentioned structure, since the cleaner case 12 and the resonators 15 and 16 are arranged side by side, and the ducts 13 and 14 are provided so as to surround the periphery of the cleaner case 12 and the resonators 15 and 16, it is possible to efficiently gather the components from the inlet of the intake system to the throttle valve 2 to thereby provide the intake device 10 designed as a compact module.

In the above mentioned intake device 10, the filter element 11 can be detached by detaching the bending portion 14B of the second duct 14 from the junction portion 14A and detaching the case cap 12B from the case main body 12A.

Figure 6:
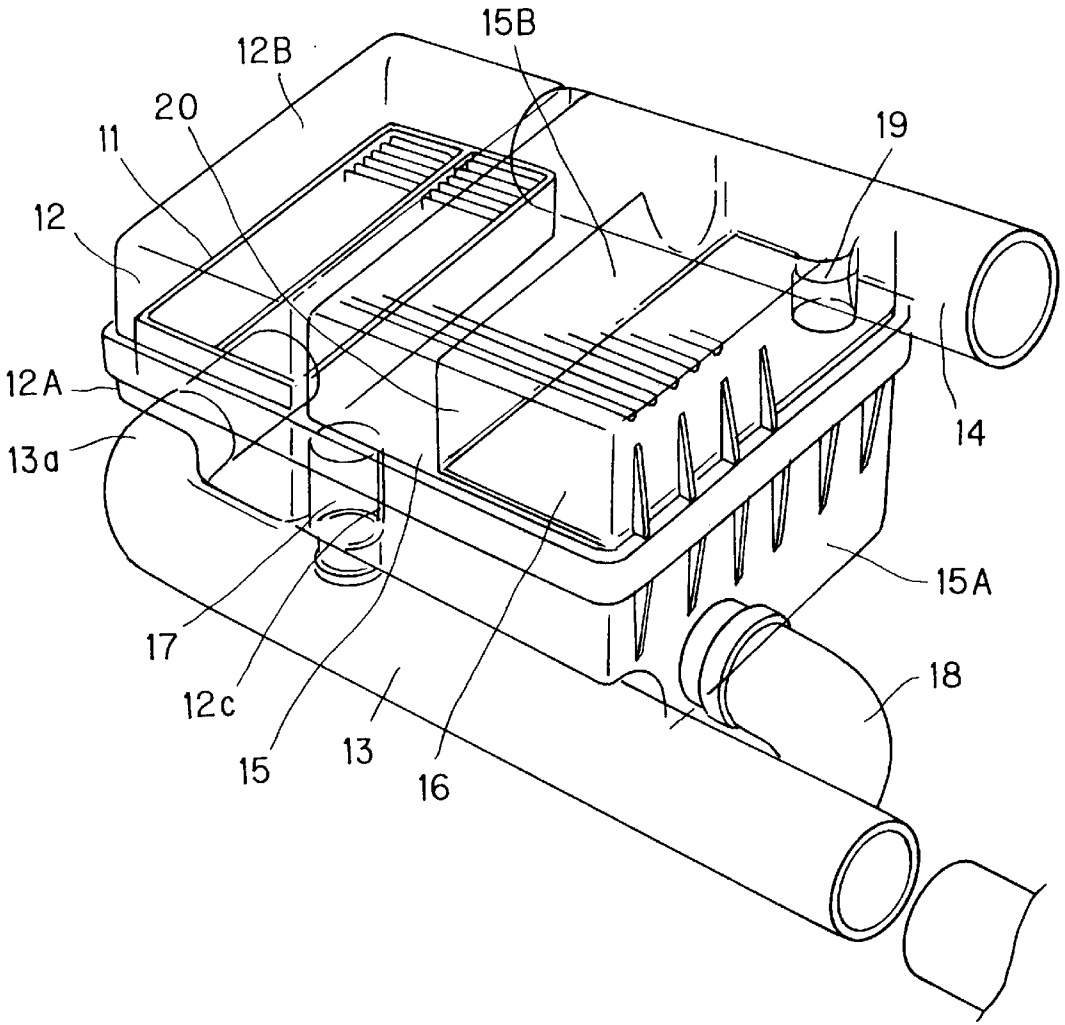
FIG. 6 is a perspective view of an air intake device in accordance with another embodiment of the present invention.
Figure 7:
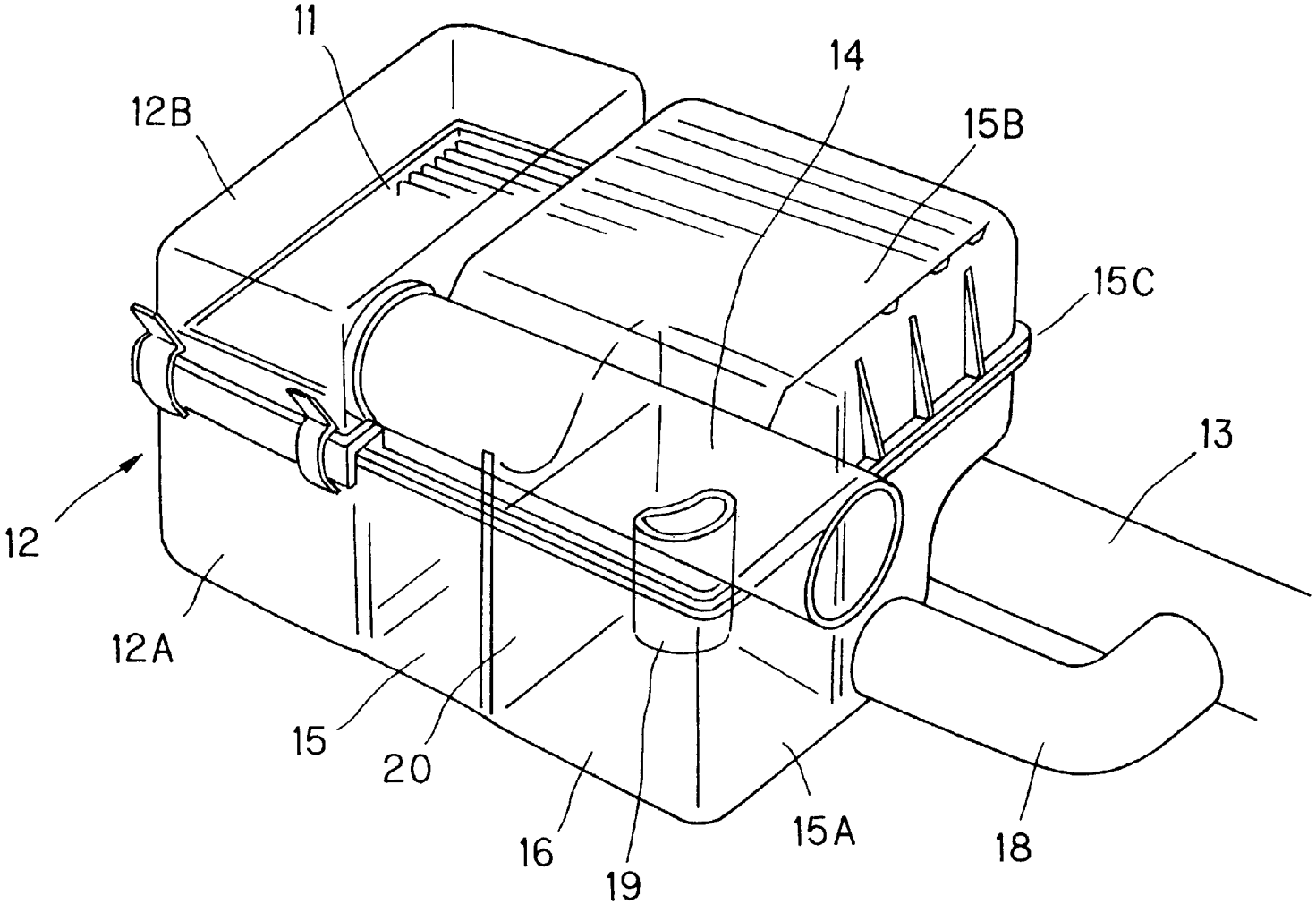
FIG. 7 is a perspective view of an air intake device in accordance with still another embodiment of the present invention.

FIGS. 6 and 7 show other embodiments of the present invention. In these figures, components corresponding to the components of the air intake device 10 shown in FIGS. 1 to 5 are denoted by the common reference numerals, respectively. In the embodiment shown in FIG. 6, the case main body 12A of the cleaner case 12 and the lower case 15A of the resonator 15 are integrally formed by the injection molding. The upper case 15B are separately molded from the other components, and then are welded to the lower case 15A. In the upper case 15B, there is provided a partition plate 20 to form the resonator 16 which is partitioned from the resonator 15. The inner space of the resonator 15 is communicated through the communication pipe 18 to the duct 13, while the inner space of the resonator 16 is communicated through the communication pipe 19 to the duct 14. On the other hand, in the embodiment shown in FIG. 7, the partition plate 20 is provided to extend over both of the lower and upper cases 15A and 15B to thereby form the resonator 16. The other features of the embodiment shown in FIG. 7 are substantially identical with those of the embodiment shown in FIG. 6.

In the embodiments shown in FIGS. 6 and 7, the cleaner case 12 is provided at one side of the intake device, while both resonators Is and 16 are provided at the other side thereof, and both ducts 13 and 14 are provided at the same side where the resonators are provided. Accordingly, it is possible to practically use the space between the ducts 13 and 14 to thereby enable the compact design of the device. Since the ducts 13 and 14 are extended substantially parallel to each other along the resonators 15 and 16, it is possible to simplify the configurations of the ducts and the resonators.

The present invention is not limited to the above embodiments, but can be carried out in various configurations. The cleaner case 12 and the resonators 15 and 16 may separately prepared from each other and may be assembled in the following process. One of the resonator 15 or 16 may be omitted if it is not necessary. The side branch 17 may also be omitted if it is not necessary. The side branch 17 may be connected to the duct 14. A plurality of the side branches 17 may be provided.

Figure 8:
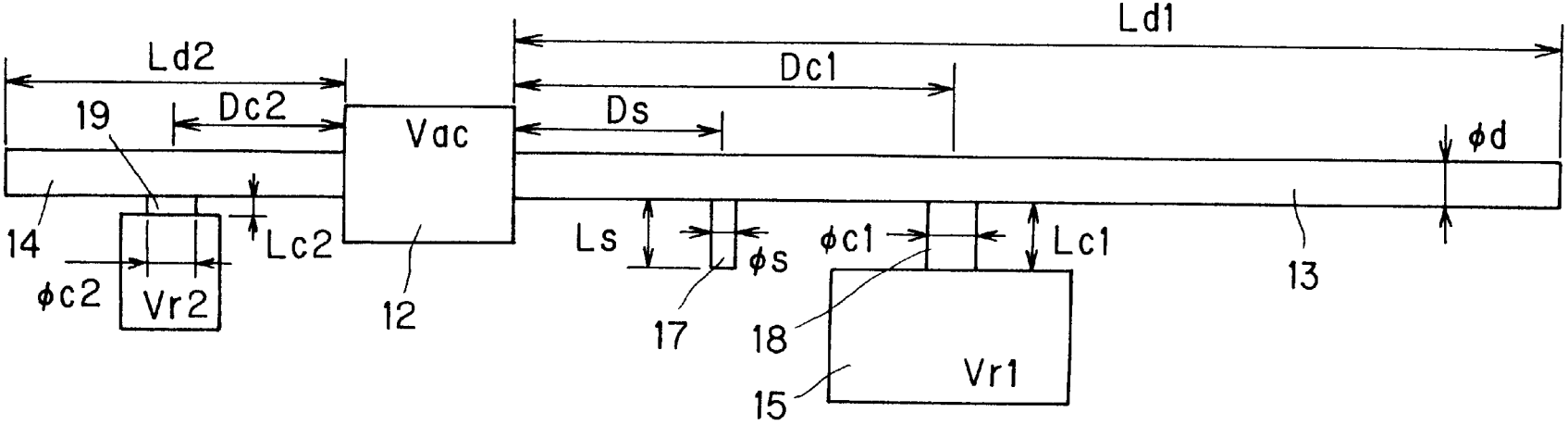
FIG. 8 is a schematic diagram showing a mutual positional relationship between a cleaner case, ducts, resonators and side branch in accordance with the embodiment of the present invention.

FIG. 8 shows a schematic diagram showing the mutual positional relationship between the cleaner case 12, the ducts 13 and 14, the resonators 15 and 16 and the side branch 17. In the study by inventors of the present invention, it is acknowledged that the sound deadening effect in the structure of FIG. 8 can be affected by the volume Vac of the cleaner case 12, the volumes Vr1 and Vr2 of the resonators 15 and 16, the entire lengths Ld1 and Ld2 of the ducts 13 and 14, the distances Dc1, Dc2 and Ds from the cleaner case 12 to each of the communication pipes 18 and 19 and the side branch 17, the entire lengths Lc1, Lc2 and Ls of the communication tubes 18 and 19 and the side branch 17, the internal diameters ϕc1 and ϕc2 of the communication pipes 18 and 19, and the internal diameter ϕs of the side branch 17. In particular, with respect to the internal combustion engine to be used in ordinary passenger car (the displacement there of is within 660 c.c. to 4000 c.c. ), the reasonable range for each value has been found as shown in the following tables.

| ITEMS | REASONABLE VALUE |
|---|---|
| ϕ d | 40 to 80 mm |
| Ld1 | 200 to 1500 mm |
| Ld2 | 100 to 800 mm |
| Vac | 2 to 10 litters |
| Vr1 | 2 to 10 litters |
| Dcl | 50 to 600 mm |
| Lc1 | Within 200 mm |
| ϕ c1 | 20 to 60 mm |
| Vr2 | 0.5 to 3 litters |
| Dc2 | Within 600 mm |
| Lc2 | Within 200 mm |
| ϕ c2 | 20 to 60 mm |
| Ds | Within 600 mm |
| Ls | 80 to 300 mm |
| ϕ s | 20 to 60 mm |

Note that, the reasonable range may further limited to the narrow extent within the above mentioned range in accordance with the displacement, the output character of the internal combustion engine or the like.

Furthermore, the second resonator 16 may be connected to the first duct 13 instead of the second duct 14. The number of the resonators is not limited to two, but three or more resonators may be provided. For example, a third resonator can be provided, and an inner space thereof may be communicated with the first or the second duct 13 or 14. The filter element 11 is not limited to the panel type, but can be changed to other types.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An air intake device for an internal combustion engine comprising:

a cleaner case in which a filter element is housed;

a first duct for introducing air into a dusty side of the cleaner case;

a second duct for introducing the air from a clean side of the cleaner case toward the internal combustion engine; and at least one resonator formed as a closed box and connected to one of the first or the second duct, wherein said at least one resonator and the cleaner case are arranged side by side, the first and the second ducts are extended along the resonator, and the cleaner case has a case main body and a case cap detachably mounted on the case main body, and at least one part of the resonator is integrally formed with at least one part of the case main body.

2. An air intake device for an internal combustion engine comprising:

a cleaner case in which a filter element is housed;

a first duct for introducing air into a dusty side of the cleaner case;

a second duct for introducing the air from a clean side of the cleaner case toward the internal combustion engine; and at least one resonator formed as a closed box and connected to one of the first or the second duct, wherein said at least one resonator and the cleaner case are arranged side by side, the first and the second ducts are extended along the resonator, and a side blanch having a tubular shape with a closed end is connected to a section of at least one of the first and the second ducts, the section being located between connecting points at which the resonator and the cleaner case are connected to said at least one of the first and the second ducts, the side branch being fitted into a recess portion provided on the cleaner case or the resonator.

3. An air intake device for an internal combustion engine comprising:

a cleaner case in which a filter element is housed;

a first duct for introducing air into a dust-y side of the cleaner case;

a second duct for introducing the air from a clean side of the cleaner case toward the internal combustion engine; and at least one resonator formed as a closed box and connected to one of the first or the second duct, wherein said at least one resonator and the cleaner case are arranged side by side, the first and the second ducts are extended along the resonator, the first or the second duct has a bending portion extending around the cleaner case while keeping space therefrom, and at least one part of the resonator is fitted in the space between the bending portion and the cleaner case.

4. An air intake device for an internal combustion engine comprising:

a cleaner case in which a filter element is housed;

a first duct for introducing air into a dusty side of the cleaner case;

a second duct for introducing the air from a clean side of the cleaner case toward the internal combustion engine; and a plurality of resonators, each of which is formed as a closed box and connected to one of the first or the second duct, wherein said resonators and the cleaner case are arranged side by side, and the first and the second ducts are extended along the resonators, the cleaner case is located at one side of the intake device, the first and the second ducts are provided at another side of the intake device, and the resonators are gathered at said another side of the intake device.

5. The air intake device according to claim 4, wherein the resonators are provided in a space formed between the first and the second ducts.

6. The air intake device according to claim 5, wherein the first and the second ducts have portions substantially parallel to each other.

7. The air intake device according to claim 5, wherein at least one of the resonators has a partitioning wall which is commonly used as a wall of another one of the resonators.

8. An air intake device for an internal combustion engine comprising:

a cleaner case provided at one side of the intake device and housing therein a filter element;

a first duct for introducing air into a dusty side of the cleaner case;

a second duct for introducing the air from a clean side of the cleaner case toward the internal combustion engine; and a plurality of resonators, each of which is formed as a closed box and connected to one of the first or the second duct, wherein the resonators are provided at another side of the intake device so as to be adjacent to the cleaner case, and the first and the second ducts are provided at said another side and extended along the resonators.

* * * * *